US005454742A

United States Patent [19]

Robertson

[11] Patent Number: 5,454,742

[45] Date of Patent: Oct. 3, 1995

[54] RADAR REFLECTIVE BUOY AND METHOD OF MANUFACTURING THE SAME

[76] Inventor: James H. Robertson, 5238 Vineland Ave., North Hollywood, Calif. 91601

[21] Appl. No.: 160,922

[22] Filed: Nov. 30, 1993

[51] Int. Cl.[6] ..... B63B 22/00

[52] U.S. Cl. ..... 441/20; 264/311; 441/23

[58] Field of Search ..... 441/1, 20, 11, 441/13, 16–18, 30, 21, 23; 264/310, 311

[56] References Cited

U.S. PATENT DOCUMENTS

| | | | |
|---|---|---|---|
| 3,299,501 | 1/1967 | Cox | 264/310 X |
| 3,390,409 | 7/1968 | Murnane | 441/18 |
| 3,965,234 | 6/1976 | Lane, Jr. | 264/311 X |
| 3,976,739 | 8/1976 | Carn | 264/311 X |
| 4,952,350 | 8/1990 | Duffy | 264/311 X |

*Primary Examiner*—Sherman Basinger
*Attorney, Agent, or Firm*—Wagner & Middlebrook

[57] ABSTRACT

A radar reflector buoy is disclosed comprising a unitary molded inflatable hollow body with an enlarged or thickened portion which is used to attach the buoy to an anchor. The thickened portion includes a mount for an internal staff and corner radar reflector. Also disclosed is a process for producing the radar reflective buoy. The process involved open molding of the attachment area from a liquid unpolymerized polymer, partially curing it with a mount for a radar reflector staff in place, transferring the attachment area to a rotational molding apparatus, inserting a radar corner reflector and rotational molding the buoy body from a compatible powdered polymer.

16 Claims, 3 Drawing Sheets

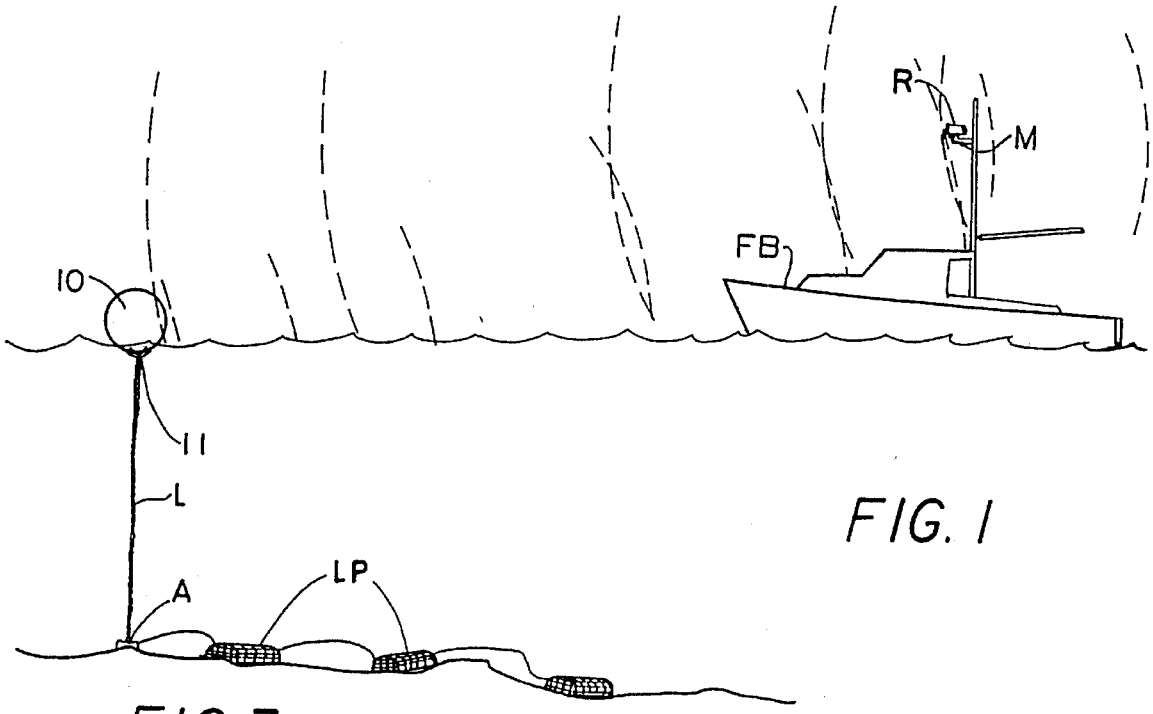
FIG. 1
FIG. 3
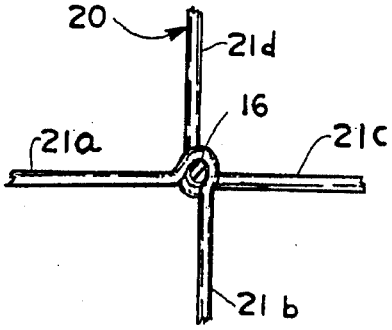
FIG. 4
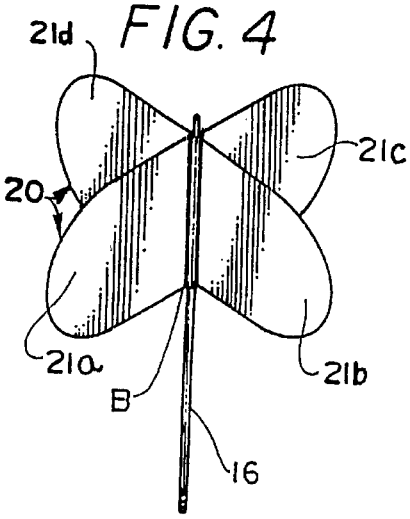
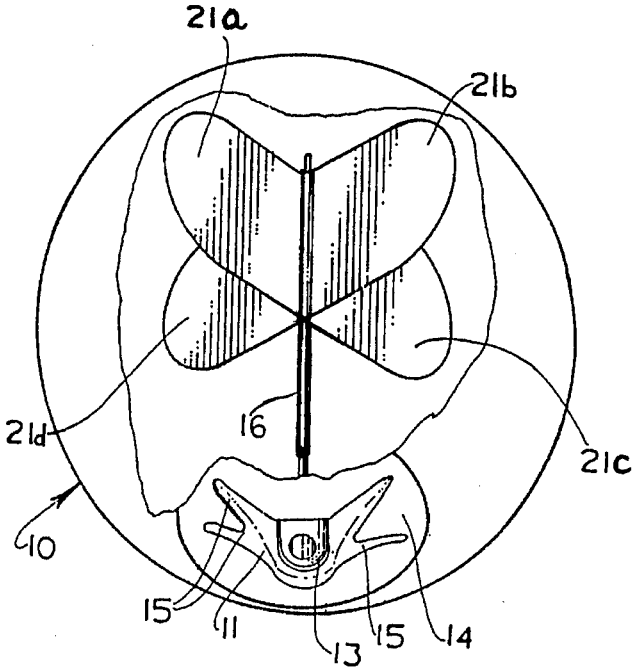
FIG. 2

FIG. 7
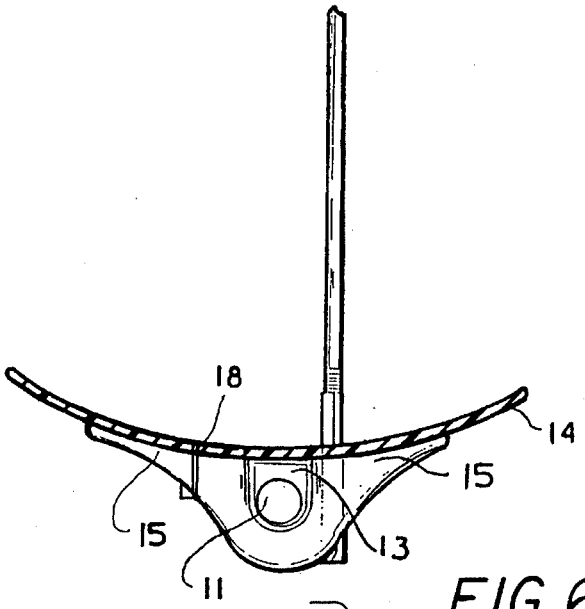
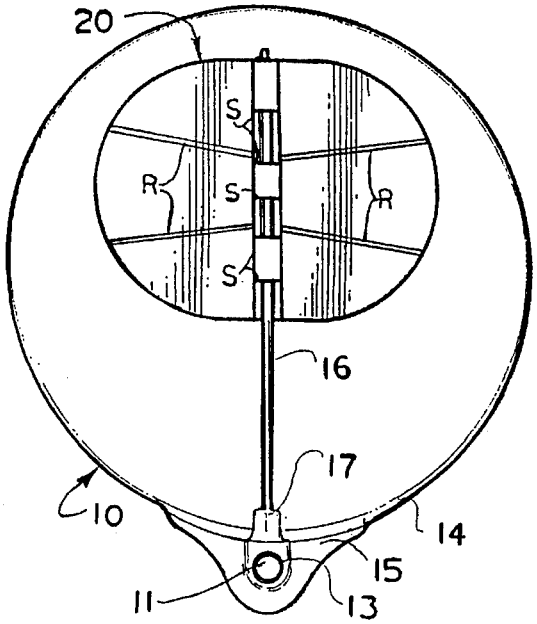
FIG. 6A
FIG. 5
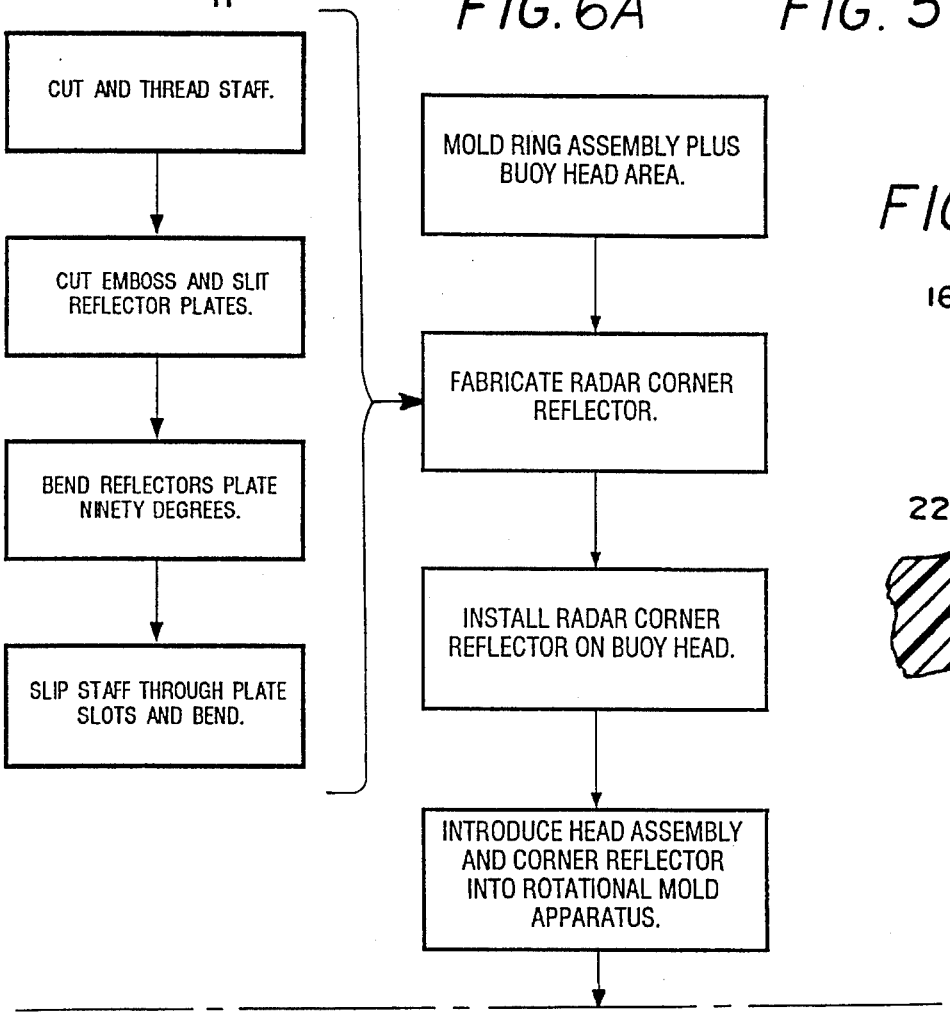
FIG. 8
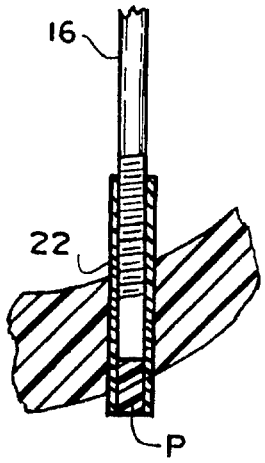

RADAR REFLECTIVE BUOY AND METHOD OF MANUFACTURING THE SAME

BACKGROUND OF THE INVENTION

From time immemorial, fishermen have used floating buoys to locate fish traps and lobster pots, and to identify fishing grounds. The buoys provide rapid identification and recovery of traps or pots and means for return to the same fishing grounds.

Buoys have been hollow glass balls in a net enclosure, and hollow metal tanks, and more recently, flexible bright colored plastic buoys with a molded in eye to allow easy sighting and identification of a buoy.

The metal type buoys are often detected under poor visibility conditions employing the vessel's navigational radar. Non-metallic buoys, particularly those of plastic, do not provide any usable radar return.

It has been a practice to attach corner-type reflectors to the tops of various types of buoys, however, exposed corner reflectors are totally incompatible with the shipboard handling which can cause their damage or destruction. Likewise, an exposed corner reflector that is typically made of light sheet metal is subject to destruction by adverse weather conditions.

I have long felt that if it were possible to provide a flexible inflatable plastic buoy with an internal radar reflector, it would become possible to detect plastic buoys with radar. If properly produced and mounted, the buoy body itself can protect the corner reflector.

Typical plastic materials used are relatively transparent to radar waves with little attenuation of the radar signal. Therefore, a corner reflector within a buoy could provide an excellent radar signature. Additionally, no special precautions need be taken in the handling of the buoy on the boat or in storage.

I have been aware that the manufacture of plastic inflatable buoys using common rotational molding techniques is totally incompatible with the installation of a relatively fragile light weight metal corner reflector in the interior of a buoy.

BRIEF DESCRIPTION OF THE INVENTION

Faced with this need for improved plastic buoys that I recognized, and with my familiarity with the limitations of rotational molding of inflatable buoys, I undertook a study to ascertain whether a radar reflective plastic buoy could, in fact, be produced.

I recognized that the attachment eye of the buoy that normally includes a much thicker section of the buoy body and reinforcing ribs could serve as a point of attachment for a corner reflector. Thus, I had a point of attachment for a rod that could support the corner reflector. I was concerned that in the rotor molding process employing unpolymerized liquid plastic, that any attempt to mold an eye assembly and a buoy body with a corner reflector in place would only result in the corner reflector being coated with polymer adding to its weight, increasing any attenuation to the radar signal and resulting in an unsatisfactory product.

It occurred to me that it is possible to produce a radar reflective buoy with an internal corner reflector by first molding the heavier portion of the buoy body, namely the eye portion. Separately, I fabricated a corner reflector having an elongated staff that threadably engages a mating threaded recess in the buoy eye region. The staff is of sufficient length to hold a metal corner reflector in the portion of the buoy normally extending above the water line. The eye assembly and corner reflector are introduced into a rotational molding machine that is equipped to mold conventional buoys without any modification of the equipment.

The rotational molding machine is then charged with powdered or granular unpolymerized polymer, rotated to evenly spread the polymer throughout the interior of the mold with none of the polymer adhering to the corner reflector. The polymer is next cured through heat and is bonded to the eye portion. The mold is then opened and the buoy with the corner reflector totally enclosed is removed.

The corner reflector is dimensioned to largely fill the portion of the buoy extending above the water. The corner reflector has sufficient clearance with the buoy body that any normal handling of the buoy in which there is momentary indentation of the surface, the corner reflector is not touched. Even if a severe dent occurs in the surface, the elongated stem for the corner reflector has sufficient resilience to allow the corner reflector to momentarily deflect-out of the way. The end result is that a buoy with all the external appearance of a conventional buoy is now truly radar reflective.

In tests we have detected a buoy at a range of ½ mile using a typical fishing boat radar where non-radar reflective equipped buoys could not be detected visually.

BRIEF DESCRIPTION OF THE DRAWING

This invention may be more clearly understood from the following detailed description and by reference to the drawing in which:

FIG. 1 is a simulated view of the operating environment of this invention;

FIG. 2 is a perspective view of a buoy incorporating this invention with portions broken away to show the radar corner reflector within its interior;

FIG. 3 is an end view of the preferred form of radar corner reflector in accordance with this invention;

FIG. 4 is a perspective view thereof;

FIG. 5 is a vertical sectional view through the buoy of FIG. 2;

FIG. 6A is a partial flow diagram of the process for fabricating a buoy in accordance with this invention;

FIG. 7 is an enlarged fragmentary view of the eye portion of the buoy of FIG. 2; and FIG. 8 is an enlarged fragmentary view of the staff mounting arrangement of this invention.

DETAILED DESCRIPTION OF THE INVENTION

A typical operational environment of this invention is illustrated in FIG. 1 in which a fishing boat FB is shown with its radar antenna R located on its mast M. A set of lobster pots LP on the bottom are identified by a buoy, generally designated 10 tethered by a line or chain L to its anchor A. The buoy 10 has an eye 11 securing the buoy 10 to the line L at the appropriate depth so that it will remain floating with a portion of its body 12 above the surface. Typically the buoy body 12 is molded of a plastic material such as 74 shore flexible vinyl with a wall thickness in the order of ⅛" inch and a diameter of between one to three feet in diameter.

The preferred diameter is 24 and 19 inches for most applications.

The buoy 10 has all of the exterior appearance of typical prior art buoys and may be stored, deployed and recovered in exactly the same procedures as prior fishing buoys. This buoy 10 is of the inflatable/deflatable type but after manufacture is inflated to its normal pressure of 1–2 pounds at all times.

Figure 6B:
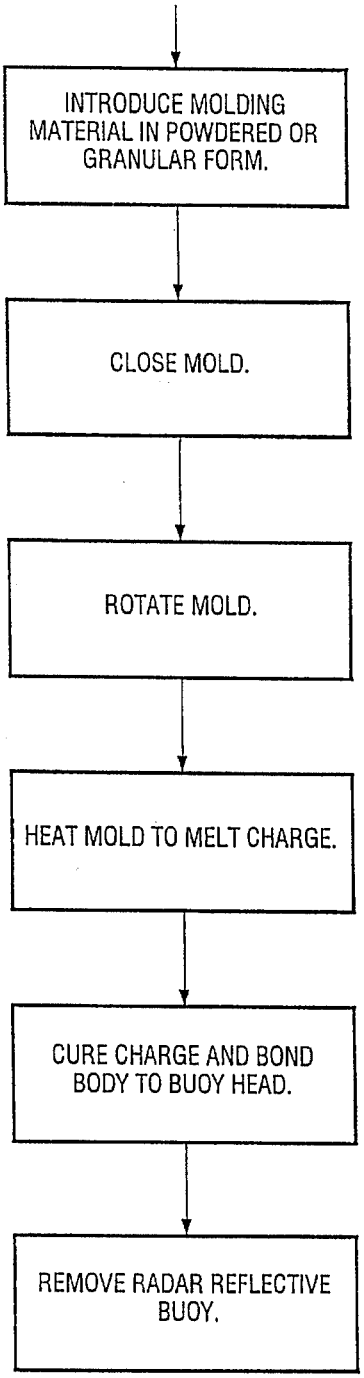
FIG. 6B is a continuation of the flow diagram of FIG. 6A.
Figure 6:
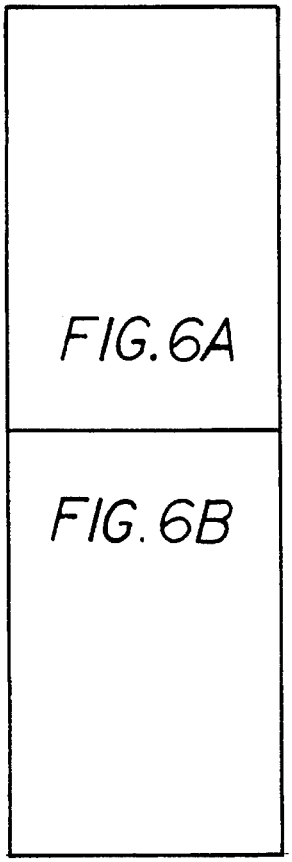
FIG. 6 shows the relationship between FIGS. 6A and 6B.

The unique features of this invention may be seen by reference to FIGS. 2 through 5 and 7 showing the structure of the buoy 10 and FIG. 6 describing its method of manufacture. Referring now to FIGS. 2, 5 and 7, the eye 11, in fact, is an integrally molded upstanding attachment point for the line L of FIG. 1. The eye is located in a pillar 13 that is integrally molded into the base portion 14 of the buoy 10. The pillar is reinforced by ribs 15 which help to distribute loading on the body caused by wave action when in use and strains due to shipboard handling. The base 14 is of greater thickness than the body 12 since this is the region of the buoy that is normally subject to the greatest stress. The eye 11 may have a metal bearing molded in place for additional wear protection. The head area 14 also has an air valve 18 imbedded therein and a bushing 22, the latter for supporting the staff 16.

The corner reflector 20 is fabricated after cutting into its general oval shape shown in FIG. 5. Next, it is stamped to form stiffening ribs R and slits S and upset and downset portions to define a circular opening for the staff 16. Next each corner reflector plate is bent to a 90 degree corner and the staff 16 inserted in the circular opening formed by the two reversed and nested corner reflector plate members 21*a*, 21*b* and 21*c*, 2*d*. The staff is next bonded in place using a bonding agent such as two part epoxy resin glue. The staff 16 and corner reflector 20 are now ready for installation in the buoy head area.

The buoy 10, in its preferred form, is generally spherical in shape, as shown and in the broken away portion of FIG. 2, a staff 16 for a radar corner reflector 20 may be seen. The staff 16 extends generally diametrically through the hollow interior of the buoy 10 from its securement point in a boss 17 on the inner side of the eye 11 as may be seen in FIG. 7. In FIG. 2, the boss 17 is concealed by the base portion 14. The staff 16 is preferably of 5/16" hardened aluminum rod to have sufficient stiffness to support the corner reflector that is made up of four vanes 21*a–d* secured to the staff 16 and arranged at 90 degree azimuth angular spacing in conventional corner reflector practice. The staff 16 is preferably secured to the boss 17 by being threaded into an embedded threaded bushing 22 which may be seen in FIG. 8.

The vanes 21*a–d* may be fabricated from a pair of sheets of radar reflective material such as 0.0086 inch aluminum, each with a 90 degree bend and located on opposite sides of the staff 16. In such case, the 90 degree bend is shown as the linear bend B of FIG. 4 in which vanes 21*a* and 21*b* are a single piece and vanes 21*c* and 21*d* are the second sheet metal piece. The head area 14, particularly the pillar 13 and rib 15 region varies from one half to two inches in thickness. This provides a sturdy base for mounting the staff 16 supporting the corner reflector 20. Also, an air valve 18 for filling and maintaining a one to two pound positive pressure in the buoy is embedded in the head area 14. Such a pressure is sufficient to maintain the buoy fully inflated for normal operating conditions. Removable plugs P seal the exterior of the air valve 18 and the staff supporting bushing 22.

The corner reflector 20 in the shape shown, 12 inches high and 16 inches in length provides approximately 168 sq. inches of reflective surface regardless of the azimuth direction of incident radar waves. This is a sufficient size target for easy reliable detection in open waters by conventional fishing or small boat navigation radar systems at a range of ½ mile.

The corner reflector 20 is totally enclosed within the body 11 having a typical wall thickness of ⅛ inch. When fabricated of flexible vinyl material of durometer shore hardness in the 70 range, the body 11 has sufficient stiffness and durability to be an effective long lived buoy. Since no part of the corner reflector is exposed to the elements, the operative life of the buoy is by no means reduced by reason of the presence of the corner reflector. Additionally, the body 12 may be locally dented in handling on shipboard or when anchored without damage to the internal corner reflector. Typically the corner reflector 20 has a clearance at the edge of the vanes in the order of 10% to 20% of the buoy diameter. For example, in a 24 inch diameter buoy, the corner reflector normally has a 4 inch clearance from the interior wall of the body 12. If extreme contact is made with the buoy 10 causing the buoy to deflect, the staff deflects with the buoy and with the removal of the denting force, returns to its normal diametrical and vertically oriented position.

It should be noted that the staff 16 is greater in length than a radius or half length of the buoy with the corner reflector 20 generally located opposite the eye 11. Therefore the corner reflector 20 is located in the volume of the buoy that is normally out of water. In its normal orientation the buoy presents its maximum area exposure of the corner reflector and therefore provides a solid radar signature.

This corner reflector 20 is possible and practical since it can be produced in a process that is compatible with the normal manufacturing processes and equipment used in the manufacture of standard plastic buoys.

In accordance with this invention, the buoy of FIGS. 1–5 and 7 is produced in a composite process which is primarily rotational molding but using different molding material and using a two molding step process.

Referring now to FIGS. 6A and 6B, for a flow diagram of the manufacturing process for the radar reflective buoy of this invention, the ring assembly including the eye 11, the pillar 13, the head region 14, and the aluminum threaded bushing 22 are all molded in a pour and heat open top molding apparatus using a charge of vinyl of 92 durometer of shore hardness in the 70 range. The head area 14 is molded employing an open top female mold with a cavity which matches the eye region 13 and the ribs 15. The air valve assembly 18 and bushing 22 are placed in the open top mold and it is filled to the edge with at least ⅛ inch wall thickness at the edge. The molding material is liquid vinyl of the same type used for the body of the buoy or at least compatible and bondable to the buoy body.

The vinyl is partially cured with curing occurring at the mold surface first. Some excess uncured vinyl may be siphoned off of the surface to remove unneeded weight while maintaining a thickness ¼–1 inch thickness in the open top portion of the mold. When the head area is sufficiently cured to hold its shape and support the corner reflector 20 and staff 16, it is removed from the open top mold.

The head assembly 14 is next transferred to a rotational molding apparatus such as the type manufactured by the McNeil Company of Akron, Ohio. Other molding apparatus may be used however, the combination of open molding of the head area and rotational molding of the body has proved to be by far the most satisfactory method of producing this buoy.

The radar corner reflector and staff are manufactured separately and assembled using conventional sheet metal and rod cutting and threading processes.

Next the staff 16 is threaded into the bushing 22 within the rotational molding apparatus. This is done while the two hemispherical halves of the rotational molding apparatus of the mold are separated. The staff 16 and corner reflector 20 extend nearly to the opposite end of the mold when closed.

The molding material is introduced into the mold either before closing or after closing depending upon the mold design. The molding material is in powder or granular form and not the conventional liquid form.

The closed mold is rotated to evenly distribute the molding material about its interior wall.

The mold is heated while rotating and maintained in a liquid form while it polymerizes to form a uniform thickness wall and to bond it to the partially cured head until the entire body and head are fully polymerized.

The mold may then be cooled, opened and the buoy is removed and immediately inflated. It is then ready for use.

Employing this process the first effective and practical molded plastic radar reflector buoy is produced.

The above described embodiments of the present invention are merely descriptive of its principles and are not to be considered limiting. The scope of the present invention instead shall be determined from the scope of the following claims including their equivalents.

What is claimed is:

1. A radar reflective buoy comprising a closed hollow generally spherical body of generally radar wave transparent material having an internal surface;

a mounting structure attached to said body including an external eye;

a radar reflector;

an elongated staff supported in said mounting structure mounting said radar reflector within said body; all parts of said radar reflector being spaced from said internal surface and wherein said staff extends in a generally diametrical direction and said radar reflector is secured to said staff at the opposite portion of said staff from its attachment to said mounting structure.

2. A radar reflective buoy in accordance with claim 1 wherein said buoy is of flexible polymerized plastic material.

3. A radar reflective buoy in accordance with claim 1 wherein said radar reflector is a corner reflector.

4. A radar reflective buoy in accordance with claim 1 wherein said buoy includes an external attachment for securing the buoy and said radar reflector is generally located within the interior of said body opposite from said external attachment.

5. A radar reflective buoy comprising a closed hollow body of plastic material having an axis and including a thickened portion having an external eye thereon;

a radar reflector;

said thickened eye portion including mounting means mounting said radar reflector within said body;

an elongated staff secured to said mounting means and extending generally along an axis of the body of the buoy;

said radar reflector being secured to said staff and positioned within said body in a manner to provide a radar target within said body.

6. The buoy in accordance with claim 5 wherein said buoy is generally spherical and wherein said staff extends in a generally diametrical direction and said radar reflector is secured to said staff at the opposite portion of said staff from its securement to said mounting means.

7. A radar reflective buoy in accordance with claim 5 wherein said radar reflector includes an outer surface which generally conforms to the surface of said body but is spaced therefrom to minimize contact with the body in the event of localized denting of the body.

8. A radar reflective buoy in accordance with claim 7 wherein said staff is resilient to allow deflection thereof in the event of severe localized denting of said radar reflective body.

9. A radar reflecting buoy in accordance with claim 5 wherein said buoy is produced by the process comprising the steps of forming the eye region of said buoy from polymerizable material including a mounting for the staff;

producing a radar reflective body and said staff as a unit;

inserting said eye unit and assembled radar reflective unit in a rotatable mold with a dry mixture of polymerizable material compatible and bondable to the material of the eye region;

rotating the mold to distribute the dry polymerizable material around the periphery of the mold to provide the major portions of the volume of the buoy body with substantially no polymerizable material adhering to the radar reflector;

curing the material to form the body and bond the body to the eye unit; and removing the cured buoy from the mold.

10. The method for producing molded plastic buoys having radar reflective properties comprising:

molding a head area of a buoy having thickened portion including an attachment eye from an uncured polymer;

installing a staff and radar corner reflector in said head area with the staff secured to said head area;

inserting the head area and radar corner reflector in a rotational molding apparatus with a polymer compatible and bondable to said uncured polymer;

rotationally molding a hollow buoy body enclosing the radar corner reflector and staff with said buoy body bonded to the head area; and removing the completed buoy from the rotational molding apparatus.

11. The method in accordance with claim 10 wherein the molding of the head area is performed in an open top cavity.

12. The method in accordance with claim 11 wherein the molding material of the head area is only partly polymerized in the open top cavity.

13. The method in accordance with claim 10 wherein the molding of the buoy body in the rotational molding apparatus employs unpolymerised polymer in powdered form wherein the rotational mold apparatus is rotated to prevent the polymer from adhering to the radar reflector.

14. The method in accordance with claim 10 wherein the polymer used in molding the head area and the buoy body are bondable to each other to produce a unitary buoy.

15. The method in accordance with claim 10 wherein the polymers used are vinyl.

16. The method in accordance with claim 10 wherein the polymer used in the molding of the head area has a durometer shore hardness greater than the hardness of the polymer of the buoy body.

* * * * *